US005477579A

United States Patent [19]

Rones

[11] Patent Number: 5,477,579

[45] Date of Patent: Dec. 26, 1995

[54] POLISHING AND SCRUBBING PAD

[75] Inventor: James M. Rones, Atlanta, Ga.

[73] Assignee: Americo, Acworth, Ga.

[21] Appl. No.: 330,722

[22] Filed: Oct. 28, 1994

[51] Int. Cl.[6] ..... A47L 11/14; B24B 29/00

[52] U.S. Cl. ..... 15/98; 15/230

[58] Field of Search ..... 15/230, 230.14, 15/230.16, 230.17, 230.18, 98; D32/15, 19

[56] References Cited

U.S. PATENT DOCUMENTS

| | | | |
|---|---|---|---|
| 269,688 | 12/1882 | Levett | 15/230 |
| 3,417,420 | 12/1968 | Rock | 15/230.16 |
| 4,086,068 | 4/1978 | Hedin . | |
| 4,502,174 | 3/1985 | Rones | 15/98 |
| 4,598,440 | 7/1986 | Wilson | 15/230.16 |
| 4,724,567 | 2/1988 | Rones | 15/98 |
| 5,012,545 | 5/1991 | Boy | 15/230.12 |

FOREIGN PATENT DOCUMENTS

| | | | |
|---|---|---|---|
| 2927318 | 2/1981 | Germany | 15/230 |

*Primary Examiner*—Edward L. Roberts, Jr.
*Attorney, Agent, or Firm*—Sughrue, Mion, Zinn, Macpeak & Seas

[57] ABSTRACT

A rotary, floor polishing and scrubbing pad for a rotary floor polishing machine is provided and includes an elongated member having a generally hourglass shape. The hourglass shape is defined by oppositely disposed, concave side walls extending between a pair of spaced apart outer walls. The concave side walls define cutting edges for cutting away dirt and wax on a floor and then slinging any loosened debris away from the polishing and scrubbing pad during rotation thereof by the rotary floor polishing machine.

9 Claims, 2 Drawing Sheets

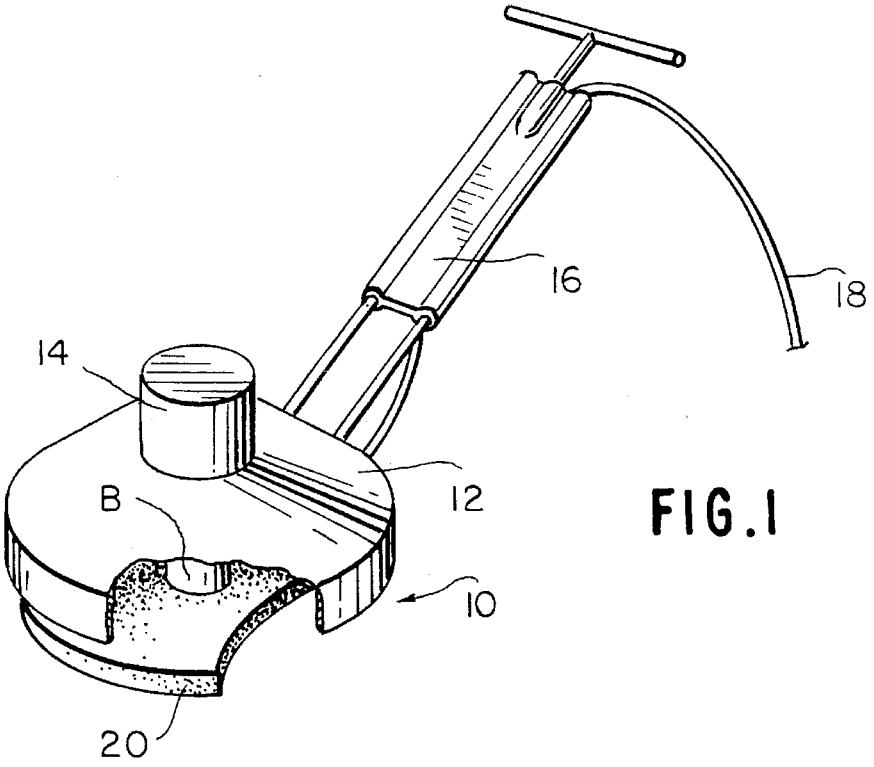
FIG. 1
FIG. 2
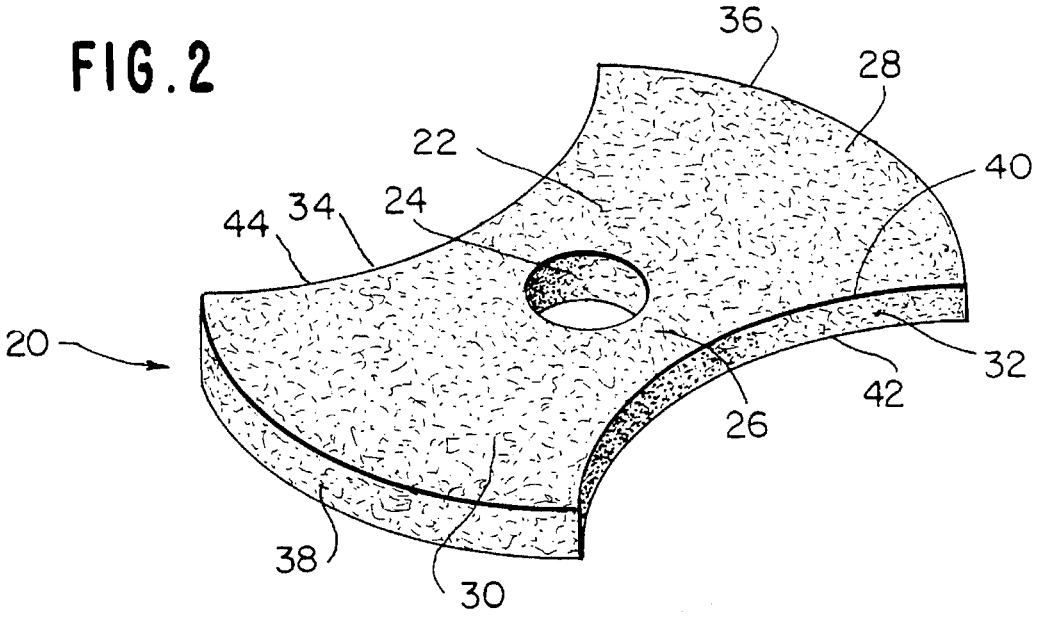

POLISHING AND SCRUBBING PAD

BACKGROUND OF THE INVENTION

1. Field of the Invention

My invention provides a polishing and scrubbing pad of the type used with electric or propane fueled internal combustion engine polishing machines.

2. Description of the Related Art

In general, numerous structures of polishing pads for use with floor polishing machines are known in the art. These pads conventionally have a central aperture for attaching them to the undersurface of a polishing machine. U.S. Pat. No. 4,502,174 (Rones), U.S. Pat. No. 4,724,567 (Rones) and U.S. Pat. No. 5,012,545 (Boy) are representative of the conventional rotary type cleaning and polishing pad. The conventional circular floor pads, such as in the Boy patent, do not present cutting surfaces to cut dirt and wax from the floor and have no means for removing any loosened dirt or wax. Accordingly, such circular pads tend to glaze over faster when the dirt and wax penetrate up into the pad and glaze over the abrasive, thereby preventing the pad from performing effectively. Additionally, such conventional pads create a great amount of drag on the polishing machine which often results in overheating and consequent overloading of electrical circuits.

While the polishing pad of the Rones '174 patent provides a plurality of apertures in the pad in order to reduce drag, there are no cutting edges to cut the wax or dirt away from the floor, nor is there any means for slinging the debris away and out from under the pad.

The Rones '567 patent teaches a polishing and scrubbing pad which provides cutting edges for cutting old wax from the floor. However, since the pad is comprised of a plurality of segments which are held together by a connector comprising a plate and a plurality of rods, the resulting structure is bulky and complicated and requires a number of steps to manufacture. Moreover, the segmented pad of Rones '567 has no provision for slinging the debris away and out from under the pad once any dirt or wax has been cut away from the floor.

U.S. Pat. Nos. 3,417,420 (Rock) and 4,086,068 (Hedin) show various designs of elements cut from a continuous strip of material.

SUMMARY OF THE INVENTION

It is an object of the present invention to solve the above-mentioned problems of the conventional rotary cleaning pad.

In particular, it is an object of the present invention to provide a polishing and scrubbing pad for use with rotary, floor polishing machines and which has a generally hourglass shape that allows cutting edges to facilitate cutting away dirt and wax from the floor, and then which functions to sling the loosened debris away and out from under the pad, thereby enhancing the work of the pad.

It is another object of the present invention to provide a polishing and scrubbing pad for use with rotary, floor polishing machines wherein the generally hourglass-shaped polishing and scrubbing pad permits the maximum number of polishing and scrubbing pads to be cut from a single blank or web of material.

More specifically, the polishing and scrubbing pad, for use with a rotary, floor polishing machine, comprises an elongated member having a generally hourglass shape, with a reduced width central portion and enlarged outer end portions; and a central aperture formed in the elongated member for attaching the polishing and scrubbing pad to the floor polishing machine.

BRIEF DESCRIPTION OF THE DRAWINGS

Other features and advantages of the present invention will be apparent from the following description taken in connection with the accompanying drawings, wherein:

FIG. 1 is a perspective view, partially cutaway, showing a rotary floor polishing machine with the polishing and scrubbing pad of the present invention secured thereto;

FIG. 2 is a perspective view of the polishing and scrubbing pad according to the present invention;

DETAILED DESCRIPTION OF THE PREFERRED EMBODIMENT

Figure 3:
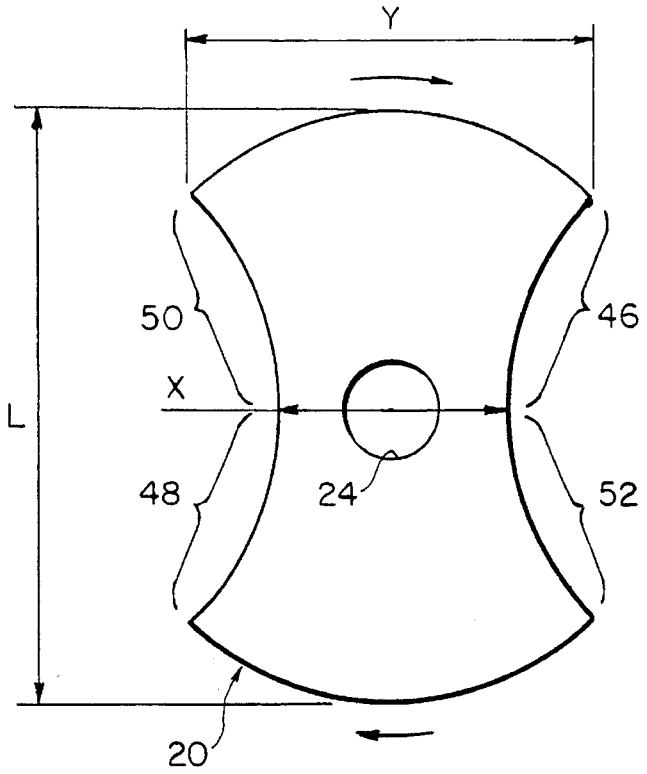
FIG. 3 is a plan view of the polishing and scrubbing pad of the present invention.

The invention Will now be described with reference to the drawings. FIG. 1 shows a rotary, floor polishing machine 10 having a polishing and scrubbing pad supporting frame 12, a motor 14, a handle 16 and an electric cord 18 for connecting the machine to a source of electrical power. While the floor polishing machine 10 is depicted as electrically powered, any other suitable power source such as a propane fueled internal combustion engine may be used.

As best shown in FIGS. 2 and 3, the polishing and scrubbing pad 20 comprises an elongated member 22 (e.g., approximately 20 inches in length) formed of a non-woven, fibrous material such as fiber glass or the like. Thus constructed, the pad 20 is durable, flexible and compressible.

The pad has a thickness of about one inch and has a central aperture 24 for receiving a boss B of the rotary, floor polishing machine.

The elongated member 22 has a generally hourglass shape, with a reduced width central portion 26 (e.g., approximately 8.5 inches across—see distance X in FIG. 3) and enlarged outer end portions 28 and 30 (e.g., approximately 14 inches across—see distance Y in FIG. 3) respectively. The reduced width central portion 26 and the enlarged outer end portions 28 and 30 of the generally hourglass-shaped elongated member 22 are defined by oppositely disposed, concave side walls 32 and 34 which extend between a pair of spaced apart outer walls 36 and 38. Each of the concave side walls 32 and 34 has a radius of curvature of approximately 10 inches. Likewise, each of the outer walls 36 and 38 is outwardly rounded and has a radius of curvature of approximately 10 inches. While the outer walls 36 and 38 are shown as being rounded, they are not limited to this shape. However, as discussed in more detail later on, the rounded shape allows a maximum number of polishing and scrubbing pads to be obtained from a single blank or strip of material.

The concave side wall 32 defines upper and lower cutting edges 40 and 42. Likewise, the concave side wall 34 defines a pair of cutting edges, only one of which (i.e., 44) is in view in FIG. 2.

As best shown in FIG. 3, assuming that the polishing and scrubbing pad 20 is rotated in a clockwise direction as indicated by the arrows, the upper right-hand edge 46 and the lower left-hand edge 48 of the pad 20 which contact the floor will actually cut the old wax and dirt from the floor being worked on.

The polishing and scrubbing pad 20 may be flipped over when a new, unused surface is desired for contacting the floor. In such a case, the pad 20 is simply removed from the rotatable shaft or boss of the rotary polishing machine and flipped over so that the unused side faces downwardly toward the floor. In such a position, a brand new surface as well as new leading or cutting edges are now in contact with the floor.

Moreover, if the electric motor 14 of the rotary polishing device is a reversible one, then, assuming that the polishing and scrubbing pad 20 is rotated in a counterclockwise direction, the upper left-hand cutting edge 50 and the lower right-hand cutting edge 52 contacting the floor would serve to cut the old wax from the floor.

Furthermore, because of the concave shape of the side walls 32 and 24, when the polishing and scrubbing pad 20 is being rotated any where between 175–3000 rpm by the rotary, floor polishing machine, the debris including the old wax and dirt which has been cut from the floor is slung outwardly away from the pad due to centrifugal force, thereby enhancing the work of the pad by preventing the build up of dirt and wax which normally would penetrate up into the conventional pad and glaze over the abrasive surface of the pad.

Figure 4:
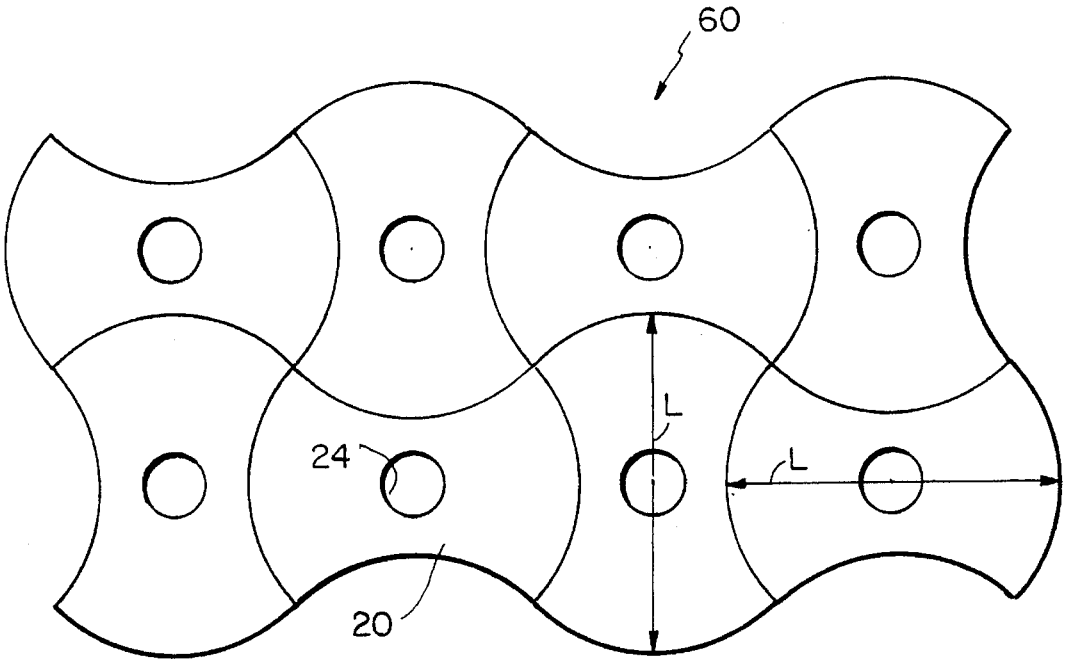
FIG. 4 is a plan view of a plurality of polishing and scrubbing pads according to the present invention disposed in a nested relationship on a strip of fibrous material.

The generally hourglass shape of each pad 20 also permits a better yield from the blank of material in which the individual pads are cut. This in turn lowers cost and also reduces the waste factor, thereby being more environmentally sensitive. FIG. 4 shows a plurality of the pads 20 disposed in a nested relationship on a strip of fibrous material 60, such that the pads alternate between a lengthwise orientation and a sideways orientation. In other words, when the pads 20 are cut from the single piece of fibrous material, the outer rounded wall of one pad and the concave side wall of an adjacent pad are formed by the same cut. In this way, only about 10 to 12% of the fibrous material is wasted when a plurality of the pads are cut from a blank strip of the material.

The polishing and scrubbing pad thus described is superior in its cutting and polishing abilities due to its hourglass shape which provides wax cutting edges which operate to sling the loosened debris away from the pad and thereby avoid the problem of the floor pad glazing over faster when dirt and wax penetrate into the pad as in the conventional floor pads. Likewise, the hourglass shape permits a greater yield from the strip of material in which the pads are cut and thereby lowers the cost and reduces the amount of waste.

While the invention has been shown and described in detail with reference to a preferred embodiment thereof, it will be appreciated and understood by those skilled in the art to which the invention pertains that various changes in form and detail may be made therein without departing from the spirit and scope of the invention.

What is claimed is:

1. A rotary, floor polishing and scrubbing pad for a rotary, floor polishing machine, comprising:

an elongated member having oppositely disposed, concave side walls extending between a pair of spaced apart outer walls, said concave side walls defining cutting edges for cutting away dirt and wax on a floor and then slinging any loosened debris away from said rotary, floor polishing and scrubbing pad during rotation thereof by the rotary, floor polishing. machine.

2. The rotary, floor polishing and scrubbing pad according to claim 1, wherein said elongated member is formed from a non-woven, fibrous material.

3. The rotary, floor polishing and scrubbing pad according to claim 1, wherein said spaced apart outer walls of said elongated member are rounded.

4. The rotary, floor polishing and scrubbing pad according to claim 1, further comprising a central aperture in said elongated member for attaching said rotary, floor polishing and scrubbing pad to the rotary, floor polishing machine.

5. In combination with a rotary, floor polishing machine having a motor, a handle and a polishing pad support; a polishing and scrubbing pad, said polishing and scrubbing pad comprising:

an elongated member formed of fibrous material of a predetermined thickness and having a generally hourglass shape, with a reduced width central portion and enlarged outer end portions; and a central aperture formed in said elongated member for attaching said polishing and scrubbing pad to said rotary, floor polishing machine, wherein said reduced width central portion and said enlarged outer end portions of said generally hourglass-shaped elongated member are defined by oppositely disposed, concave side walls extending between a pair of spaced apart outer walls, said concave side walls defining cutting edges for cutting away dirt and wax on a floor and then slinging any loosened debris away from said polishing and scrubbing pad during rotation thereof by said rotary, floor polishing machine.

6. A rotary, floor polishing and scrubbing pad for a rotary, floor polishing machine, comprising:

an elongated member formed of fibrous material of a predetermined thickness and having a generally hourglass shape, with a reduced width central portion and enlarged outer end portions; and a central aperture formed in said elongated member for attaching said rotary, floor polishing and scrubbing pad to the rotary, floor polishing machine, wherein said reduced width central portion and said enlarged outer end portions of said generally hourglass-shaped elongated member are defined by oppositely disposed, concave side walls extending between a pair of spaced apart outer walls, said concave side walls defining cutting edges for cutting away dirt and wax on a floor and then slinging any loosened debris away from said rotary, floor polishing and scrubbing pad during rotation thereof by the rotary, floor polishing machine.

7. In combination with a rotary, floor polishing machine having a motor, a handle and a polishing pad support; a polishing and scrubbing pad, said polishing and scrubbing pad comprising:

an elongated member having oppositely disposed, concave side walls extending between a pair of spaced apart outer walls, said concave side walls defining cutting edges for cutting away dirt and wax on a floor and then slinging any loosened debris away from said polishing and scrubbing pad during rotation thereof by said rotary, floor polishing machine; and a central aperture formed in said elongated member for attaching said polishing and scrubbing pad to said rotary, floor polishing machine.

8. The combination according to claim 7, wherein said elongated member is formed from a non-woven, fibrous material.

9. The combination according to claim 7, wherein said spaced apart outer walls of said elongated member are rounded.

* * * * *